US008281853B1

(12) United States Patent
Hill et al.

(10) Patent No.: US 8,281,853 B1
(45) Date of Patent: Oct. 9, 2012

(54) TOOL FOR USE IN WELL MONITORING

(75) Inventors: David R. Hill, Lorain, OH (US); Sanford A. Burris, Kirtland, OH (US)

(73) Assignee: Hytech Energy, LLC, Bakersfield, CA (US)

( * ) Notice: Subject to any disclaimer, the term of this patent is extended or adjusted under 35 U.S.C. 154(b) by 587 days.

(21) Appl. No.: 12/317,776

(22) Filed: Dec. 29, 2008

Related U.S. Application Data

(60) Provisional application No. 61/009,404, filed on Dec. 28, 2007.

(51) Int. Cl.
*E21B 47/04* (2012.01)

(52) U.S. Cl. ..... 166/90.1; 166/250.03; 166/53

(58) Field of Classification Search ..... 166/250.03, 166/90.1, 250.15, 53, 372
See application file for complete search history.

(56) References Cited

U.S. PATENT DOCUMENTS 2,047,974 A * 7/1936 Lehr et al. ..... 367/81
4,125,163 A * 11/1978 Fitzpatrick ..... 166/250.03
4,391,135 A * 7/1983 Godbey et al. ..... 73/152.55
4,727,489 A * 2/1988 Frazier et al. ..... 702/13
4,793,178 A * 12/1988 Ahern et al. ..... 73/152.58
4,934,186 A * 6/1990 McCoy ..... 73/152.58
5,117,399 A * 5/1992 McCoy et al. ..... 367/99
5,200,894 A * 4/1993 McCoy et al. ..... 702/6
5,636,693 A * 6/1997 Elmer ..... 166/370
5,715,890 A * 2/1998 Nolen ..... 166/250.03
5,823,262 A * 10/1998 Dutton ..... 166/250.15
6,085,836 A * 7/2000 Burris et al. ..... 166/250.03
6,595,287 B2 * 7/2003 Fisher ..... 166/250.15
6,705,397 B2 * 3/2004 Hershberger ..... 166/250.03
2006/0131028 A1 * 6/2006 Burris et al. ..... 166/370
2006/0133635 A1 * 6/2006 Hill et al. ..... 381/369

* cited by examiner

*Primary Examiner* — Nicole Coy

(74) *Attorney, Agent, or Firm* — James M. Duncan, Esq.; Klein, DeNatale, Goldner, Cooper, et al.

(57) ABSTRACT

A tool for use in well monitoring is described to insert devices for well fluid level control into a wellhead. The tool also permits removal of the devices for well fluid level control from an operating well for servicing. The tool also permits precise positioning of the components utilized to take measurements in the well annulus.

10 Claims, 9 Drawing Sheets

TOOL FOR USE IN WELL MONITORING

CROSS-REFERENCE TO RELATED APPLICATION

This application claims the benefit of prior U.S. provisional application 61009404 filed 28 Dec. 2007.

BACKGROUND OF THE INVENTION

1. Field of the Invention

The present invention relates to maintaining a liquid in a well such as a gas well, an oil well, or water well at a more or less constant level. Incidentally, the level of liquid in a well may be quickly ascertained.

2. Description of the Art Practices

It is known that wells replenish fluids at different rates even in the same formation or well field. The maximum production from a given well occurs when the fluid level in the well bore is as low as possible compared to the level in the surrounding formation. The rate of fluid flow into the well bore is maximized because the hydrostatic head driving the fluid is at a maximum. See for example Burris, et al. U.S. Pat. No. 6,085,836 issued Jul. 11, 2000. The Burris, et al., patent is incorporated herein by this reference.

The preceding observation suggests that the well pump should run constantly to keep the level in the well bore as low as possible thus maximizing production. Of course, this is often unsatisfactory for several reasons.

First, running the pump constantly or at too great a speed is inefficient since, some of the time, the well bore is completely empty and there is nothing to pump. Thus, energy conservation becomes a cost consideration. Second, the equipment is subject to wear and damage resulting in costly repairs when pumps are run dry.

Third, paraffin build up is more pronounced when a well is allowed to pump dry. In the dry pump condition gases are drawn into the bore. The gases in the bore then expand and cool. As the gases cool, paraffin build up is promoted as these high melting hydrocarbons begin to plate out on the surfaces of the bore.

However, a well may be pumped continuously provided that the liquid level of the well is high enough to ensue the well sump has liquid therein, e.g. avoid pumping gas into the tubing.

Given the above considerations, control strategies aimed at optimizing well production have emerged. Notably, timers have been used to control the pump duty cycle. A timer may be programmed to run the well nearly perfectly if the one could determine the duration of the on cycle and off cycle which keeps the fluid level in the bore low but which does not pump the bore dry.

The pump on cycle and off cycle can be determined for a group of wells or for an entire well field. Savings in energy may be maximized by knowing which wells fill at what rate and then optimizing pumping to reduce or maintain a constant electric load below the maximum peak available.

Given fluid level information, deciding when or how fast to run the pump is very straightforward and production can be optimized. Fluid level determinations, particularly for deep down hole (bore) systems, have been implemented. Unfortunately, these deep down hole systems have been costly and complex to install, unreliable in operation, and costly to repair or service. Although the implementation details will not be discussed here, it is worth noting that these systems, when operating correctly, have proven that significant gains in well production are available when control strategies using fluid level measurement are applied.

One system that has been attempted is the use of one-shot measurements. The one-shot measurement will use a sonic event such as a shotgun shell to generate the event. Another system is based on a nitrogen tank being utilized to generate a sonic event. In either of the foregoing systems the production of the well must be shut down to implement the sonic event and the corresponding data evaluations. By contrast the present invention will permit continuous operation of the well as the sonic events are generated, the data collected, the well conditions read out, and changes in pumping implemented. Moreover, the system of the present invention is conducted utilizing fluid from the well thus avoiding the cost of the nitrogen and does not require opening of the well to the atmosphere.

Clearly, what is needed is a control system with the advantages of fluid level measurement which is cost effective to install and operate and which is reliable. Basic features for fluid level measurement should include applicability to oil, water, or other wells and should be applicable to rod, screw (such as by a frequency drive), or other pump types.

A fluid level measurement system should be simple and inexpensive to install in the T-Head and useful for well depths to 10,000 feet. Such a fluid level measurement system should be self calibrating for each installation and accurate to 10 feet (3.1 meters). The system should be robust to harsh environments within and around the well.

A fluid level measurement system may be desired to provide fluid level measurements in wells in which gas is produced under vacuum. That is, some wells do not have sufficient pressure in the well to permit the gas to flow to the surface. For example, the well may be one in which methane is derived from a coal seam in which progressive cavity pumps are employed.

SUMMARY OF THE INVENTION

The present invention describes an insertion tool comprising: an insertion tool shaft cylinder;

said insertion tool shaft cylinder having an insertion tool shaft cylinder first end;

said insertion tool shaft cylinder having an insertion tool shaft cylinder second end;

said insertion tool shaft cylinder second end having a tapered shape;

an insertion tool shaft projection located proximate to said insertion tool shaft cylinder second end; and, said insertion tool shaft projection having a long axis substantially perpendicular to the long axis of said insertion tool shaft cylinder.

The present invention further describes an insertion tool component comprising:

an insertion tool bell;

said insertion tool bell having an insertion tool bell opening on a first region of said insertion tool bell and an insertion tool bell opening on a second region of said insertion tool bell;

said insertion tool bell opening being larger in surface area than said insertion tool bell opening and having a common axis with said insertion tool bell opening;

an insertion tool bell insert fixedly connected with said insertion tool bell opening and extending toward said insertion tool bell opening;

said insertion tool bell insert having an insertion tool bell insert first opening and an insertion tool bell insert second opening;

said insertion tool bell insert having an insertion tool bell insert inner surface at least partially defining a channel through said insertion tool bell insert;

said insertion tool bell insert having a first insertion tool bell insert bushing recess located near said insertion tool bell insert first opening; said insertion tool bell insert having a second insertion tool bell insert bushing recess located near said insertion tool bell insert second opening;

said insertion tool bell insert having an insertion tool bell insert bushing fitted within said first insertion tool bell insert bushing recess; and, said insertion tool bell insert having an insertion tool bell insert bushing fitted within said second insertion tool bell insert bushing recess.

The present invention also describes an insertion tool cable carrier tray comprising:

a pair of insertion tool cable carrier tray sidewalls;

said pair of insertion tool cable carrier tray sidewalls at least partially defining an insertion tool cable carrier tray channel;

an insertion tool cable carrier tray receiving piece fixedly connected to one end of said insertion tool cable carrier tray channel;

said insertion tool cable carrier tray receiving piece having an insertion tool cable carrier tray receiving piece first channel;

said an insertion tool cable carrier tray receiving piece having an insertion tool cable carrier tray receiving piece second channel communicating with said insertion tool cable carrier tray receiving piece first channel wherein the intersection of said insertion tool cable carrier tray receiving piece first channel and said insertion tool cable carrier tray receiving piece second channel is substantially at a right angle;

said insertion tool cable carrier tray receiving piece second channel extending above said pair of insertion tool cable carrier tray sidewalls;

an insertion tool cable carrier tray receiver locking mechanism fixedly connected to said insertion tool cable carrier tray channel at substantially the opposite end of said insertion tool cable carrier tray channel from insertion tool cable carrier tray receiving piece;

said insertion tool cable carrier tray receiver locking mechanism having at least one insertion tool cable carrier receiver locking mechanism first channel; and, said insertion tool cable carrier tray channel having at least one insertion tool cable carrier down hole opening.

Yet a further aspect of the present invention is a device for controlling fluid levels in a well comprising:

a compressor;

a conduit to provide fluid communication between a well annulus and said compressor;

a pressure transducer in fluid communication with said compressor, said pressure transducer, for when in use, to control the pressure of a sample of gas to be returned to the well annulus through gas emission tubing;

a gas receiving tubing to provide fluid communication between the well annulus and a pressure measurement device;

said pressure measurement device, for when in use to determine a return signal from the sample of gas returned to the well annulus.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

With more particular reference to the drawings the following is set forth.

DETAILED DESCRIPTION OF THE INVENTION

Figure 1:
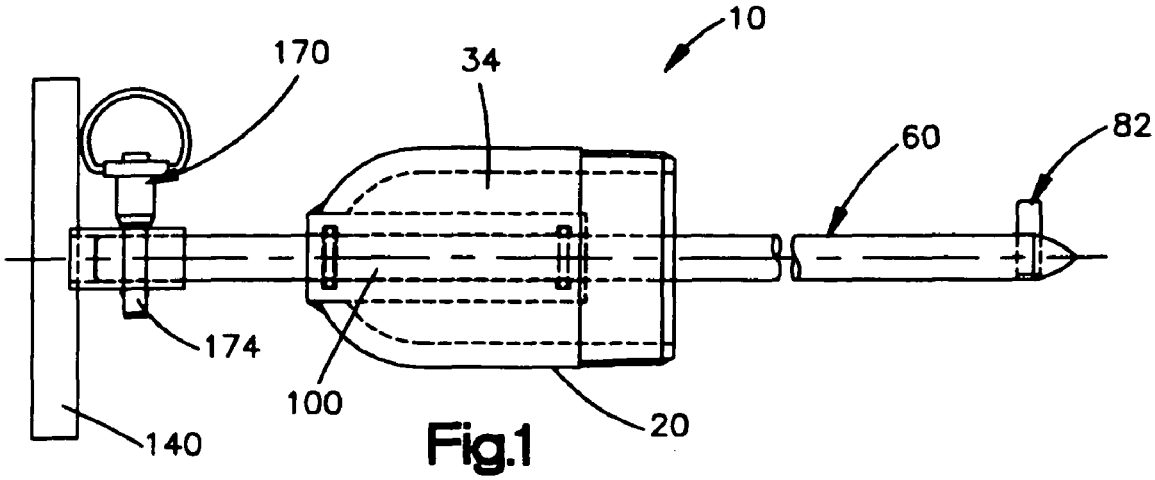
FIG. 1 is a side view of one aspect of the invention.

With reference to FIG. 1 a well Insertion tool 10 is described. The insertion tool 10 comprises an insertion tool bell 20. The insertion tool bell 20 is formed from any convenient metal and given that the insertion tool bell 20 will be in contact with other metals in the area of explosive vapors it should be born in mind to avoid great differences from the other metals with which the insertion tool bell 20 comes in contact.

A further feature of the insertion tool 10 is an insertion tool shaft 60. The insertion tool shaft 60 should also be formed of a similar metal to the insertion tool bell 20 to reduce the potential for static discharge.

Figure 2:
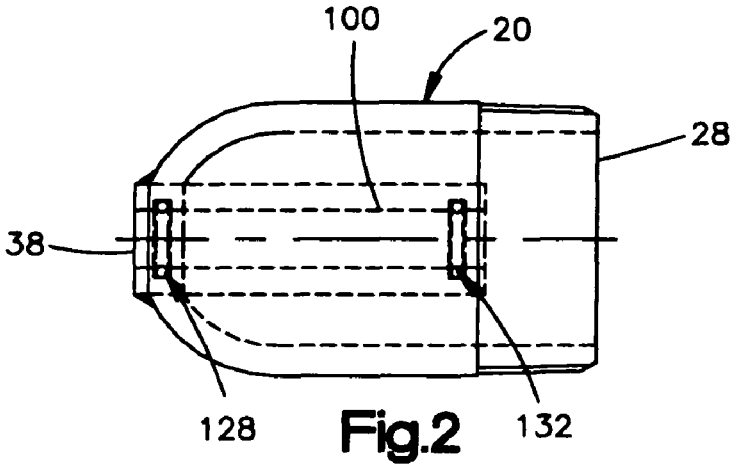
FIG. 2 is a partial view according to FIG. 1.
Figure 3:
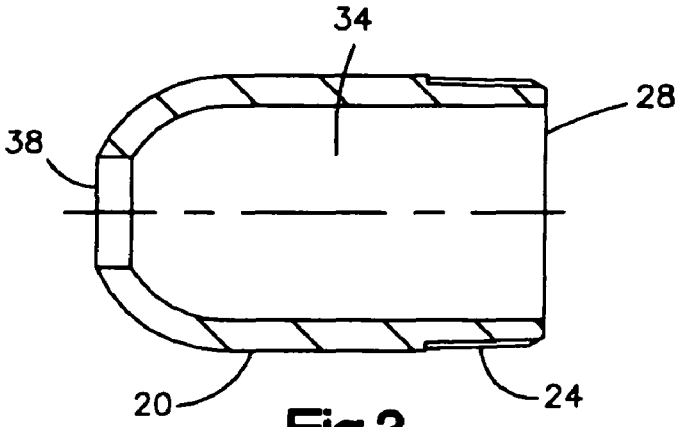
FIG. 3 is a cutaway view taken according FIG. 2.

With reference to FIG. 2, the insertion tool bell 20 has insertion tool bell external threading 24. The insertion tool bell 20 has an insertion tool bell opening 28 at least partially defined by the walls surrounding the insertion tool bell external threading 24. The interior of the insertion tool bell 20 is partially defined by chamber insertion tool bell void 34. At the opposite end from the insertion tool bell opening 28 is an insertion tool bell opening 38.

Again with reference to FIG. 1, an insertion tool bell insert 100 is fixed within the insertion tool bell 20. The insertion tool bell insert 100 is also of a similar metal to the insertion tool bell 20. When in use, the insertion tool bell insert 100 permits passage of the insertion tool shaft 60 through the insertion tool bell opening 38 and out of the insertion tool bell opening 28.

Figure 4:
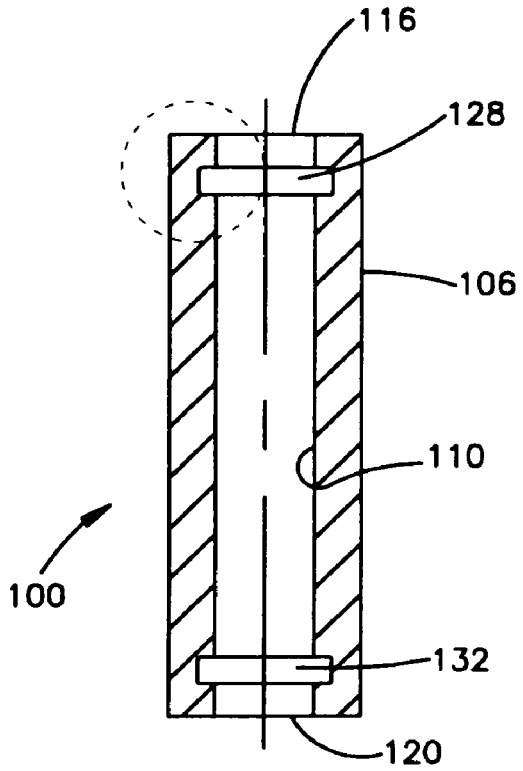
FIG. 4 is a partial sectional view according to FIG. 2.
Figure 4A:
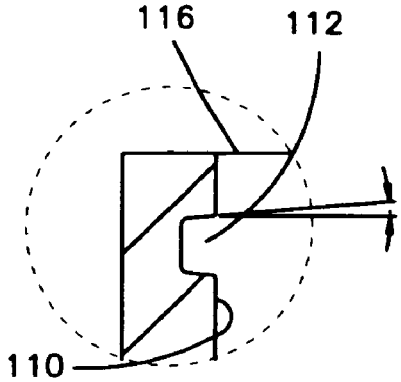
FIG. 4*a* is a partial view according to FIG. 4.

The insertion tool bell insert 100 has an insertion tool bell insert outer wall 106 and an insertion tool bell insert inner wall 110. As seen in FIG. 4A and FIG. 4, there are two insertion tool bell insert bushing recesses 112 located within the insertion tool bell insert inner wall 110 at approximately the opposite ends of insertion tool bell insert 100.

The insertion tool bell insert 100 has an insertion tool bell insert first opening 116 at one end. The insertion tool bell insert 100 has an insertion tool bell opening 120 at the other end. The insertion tool bell insert 100 is at least partially defined by the insertion tool bell insert inner surface 110. As previously noted, the insertion tool bell insert 100 permits fluid communication between the insertion tool bell insert first opening 116 at the insertion tool bell insert second opening 120.

As seen in FIG. 2, is a pair of insertion tool bell insert bushings 128 and 132 located within the two insertion tool bell insert bushing recesses 112 in insertion tool bell insert 100. The insertion tool bell insert bushings 128 and 132 are circular in design and are fixed to the insertion tool bell insert 100. When in use, the insertion tool bell insert bushing 128 and insertion tool bell insert bushing 132 serve to guide the insertion tool shaft 60 through the insertion tool bell opening 38 so that the insertion tool shaft 60 may exit from the insertion tool bell opening 28.

Figure 7:
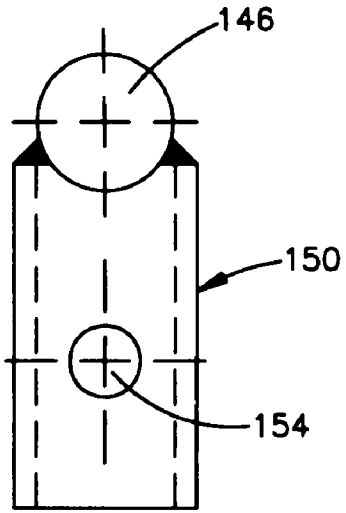
FIG. 7 is a side view according to FIG. 6.
Figure 6:
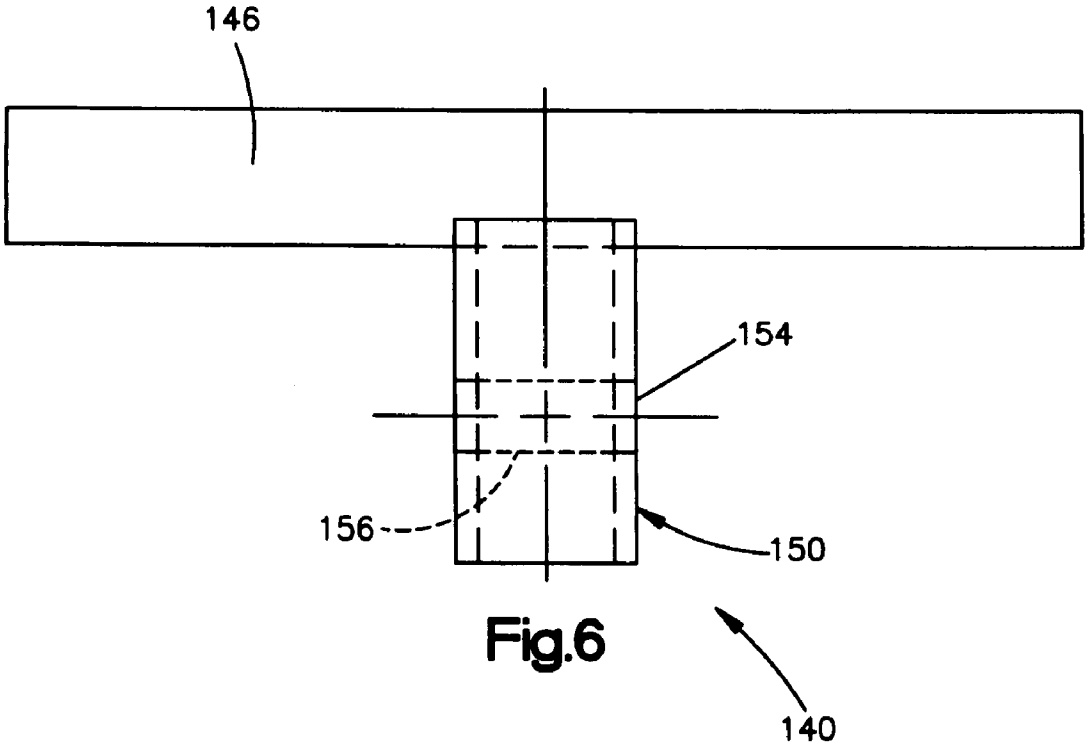
FIG. 6 is a partial view of an aspect of the invention according of FIG. 1.

With reference to FIG. 1, an insertion tool detachable handle 140 is attached to one end of the insertion tool shaft 60. The insertion tool detachable handle 140 is further described in FIG. 6 and FIG. 7. The insertion tool detachable handle 140 is comprised of the insertion tool detachable handle gripping region 146 and the insertion tool detachable handle cylinder 150.

The insertion tool detachable handle gripping region insertion tool detachable handle gripping region 146 and the insertion tool detachable handle cylinder 150 may be permanently joined together. The insertion tool detachable handle cylinder 150 has an insertion tool detachable handle cylinder 154 that at least partially defines an insertion tool detachable handle cylinder channel 156 passing through the insertion tool detachable handle cylinder 150.

As best seen in FIG. 1, an insertion tool detachable handle locking pin 170 is used by means of an insertion tool detachable handle locking pin cylinder 174 to lock the insertion tool detachable handle 140 to the insertion tool shaft 60.

Figure 5:
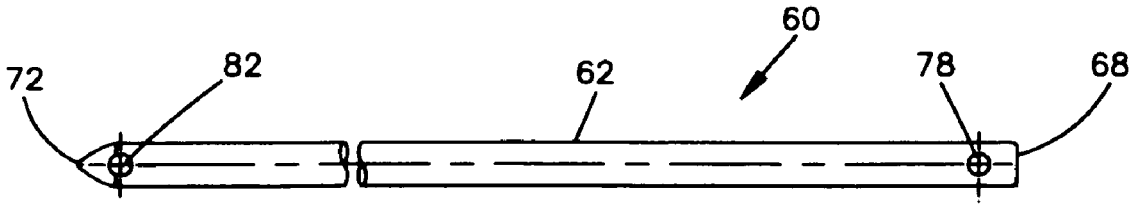
FIG. 5 is a partial view of an aspect of the invention according to FIG. 1.

Referring to FIG. 5 the insertion tool shaft 60 is further defined. The insertion tool shaft 60 is largely comprised of an insertion tool shaft cylinder 62. At one end of the insertion tool shaft cylinder 62 is an insertion tool shaft first end 68. At the opposite end of the insertion tool shaft cylinder 62 is an insertion tool shaft second end 72.

The insertion tool shaft first end 68 is a relatively flat circular surface. The insertion tool shaft second end 72 is a pointed surface, as later described, to permit Insertion of the insertion tool shaft 60 through the insertion tool bell insert 100 and into a wellhead. The insertion tool shaft cylinder 62 has an insertion tool shaft channel 78 located proximate to the insertion tool shaft first end 68.

When in use, the insertion tool shaft channel 78 receives the insertion tool detachable handle locking pin cylinder 174 to secure the insertion tool detachable handle 140 to the insertion tool shaft 60. At the opposite end of the insertion tool shaft cylinder 62 is an insertion tool shaft projection 82 located proximate to the insertion tool shaft second end 72. The insertion tool shaft projection 82 as later described functions to secure a further aspect of the convention to permit Insertion of communication equipment into a wellhead.

Figure 8:
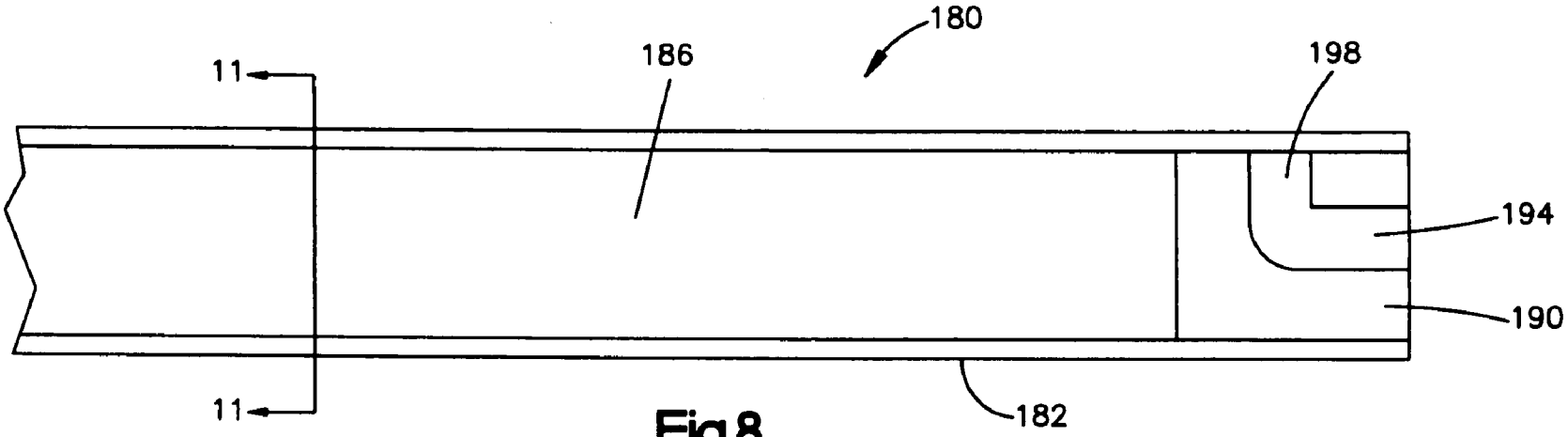
FIG. 8 is a partial plan view of a further aspect of the invention.
Figure 11:
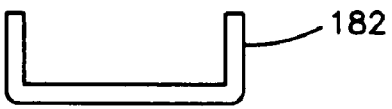
FIG. 11 is a sectional view taken along line 11-11.
Figure 10:
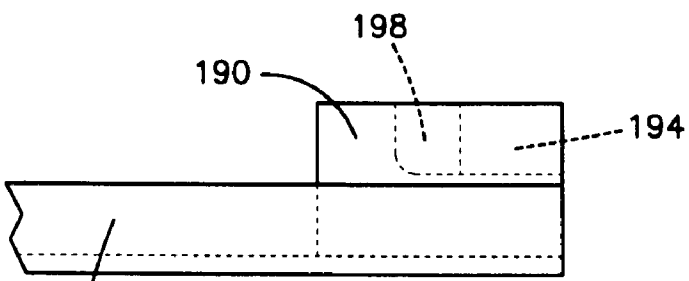
FIG. 10 is a side view taken according to FIG. 8.
Figure 9:
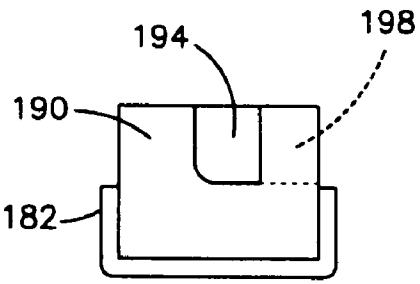
FIG. 9 is a frontal view according to FIG. 8.

Turning to FIG. 8, an insertion tool cable carrier 180 is shown. As shown in FIG. 11 the insertion tool cable carrier 180 has an insertion tool cable carrier sidewall 182 on each side. An insertion tool cable carrier channel 186 extends along the line of the insertion tool cable carrier 180. The insertion tool cable carrier 180 has an insertion tool cable carrier receiving piece 190 located at one end thereof.

The insertion tool cable carrier receiving piece 190 has located therein an insertion tool cable carrier receiving piece first channel 194. As seen in FIG. 8, the insertion tool cable carrier receiving piece first channel 194 makes a right angle turn defined in part by an insertion tool cable carrier receiving piece second channel 198.

Figure 12:
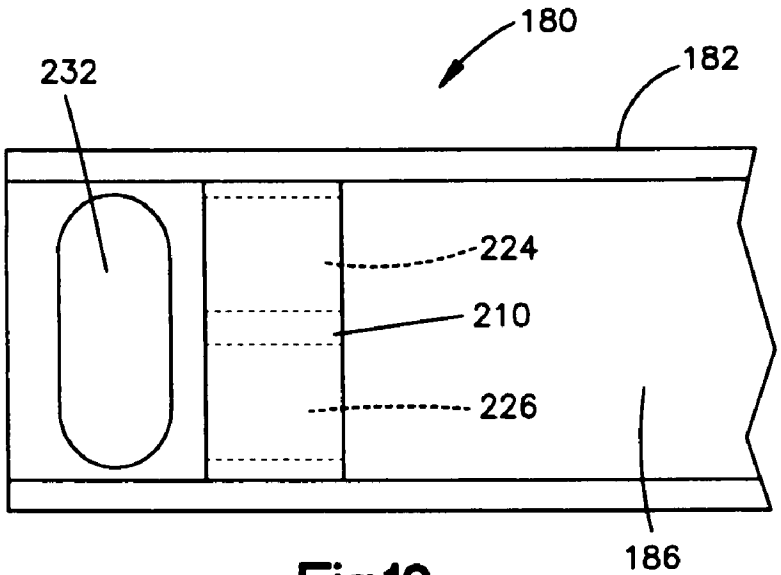
FIG. 12 (a continuation of FIG. 8) is a partial plan view of a further aspect of the invention.
Figure 14:
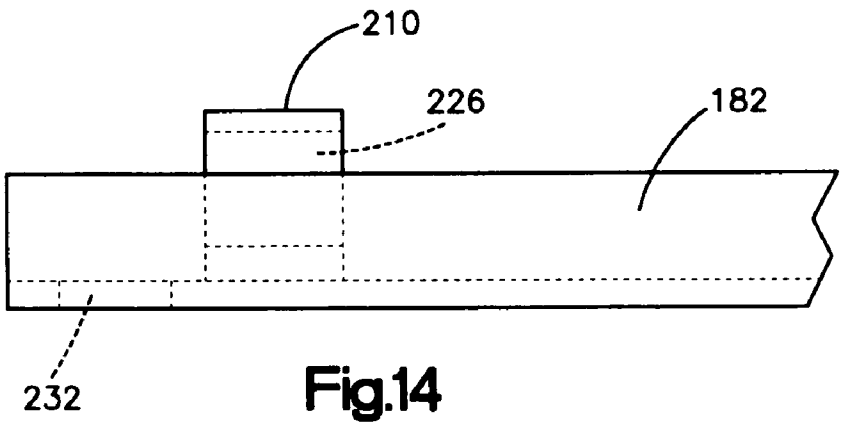
FIG. 14 is a side view according to FIG. 12.
Figure 13:
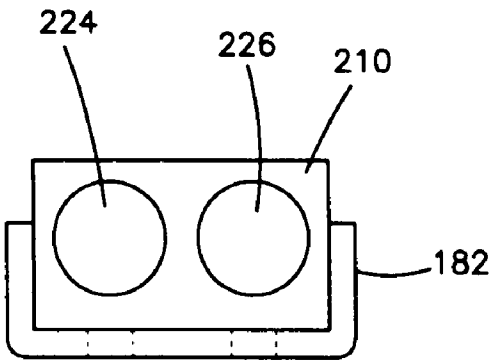
FIG. 13 is a frontal view according to FIG. 12.

Referring now to FIG. 12, FIG. 13, and FIG. 14 the second end of the insertion tool cable carrier 180 is described. An insertion tool cable carrier tray receiver locking mechanism 210 is at the opposite end of the insertion tool cable carrier 180 from the insertion tool cable carrier receiving piece 190.

An insertion tool cable carrier receiver locking mechanism first channel 224 extends through the insertion tool cable carrier receiver locking mechanism 210. An insertion tool cable carrier receiver locking mechanism second channel 226 also extends through the insertion tool cable carrier receiver locking mechanism 210.

The insertion tool cable carrier receiver locking mechanism first channel 224 and the insertion tool cable carrier receiver locking mechanism second channel 226 are parallel to the long axis of the insertion tool cable carrier 180. An insertion tool cable carrier down hole opening 232 extends through the insertion tool cable carrier tray receiver locking mechanism 210 of the insertion tool cable carrier 180.

Figure 15:
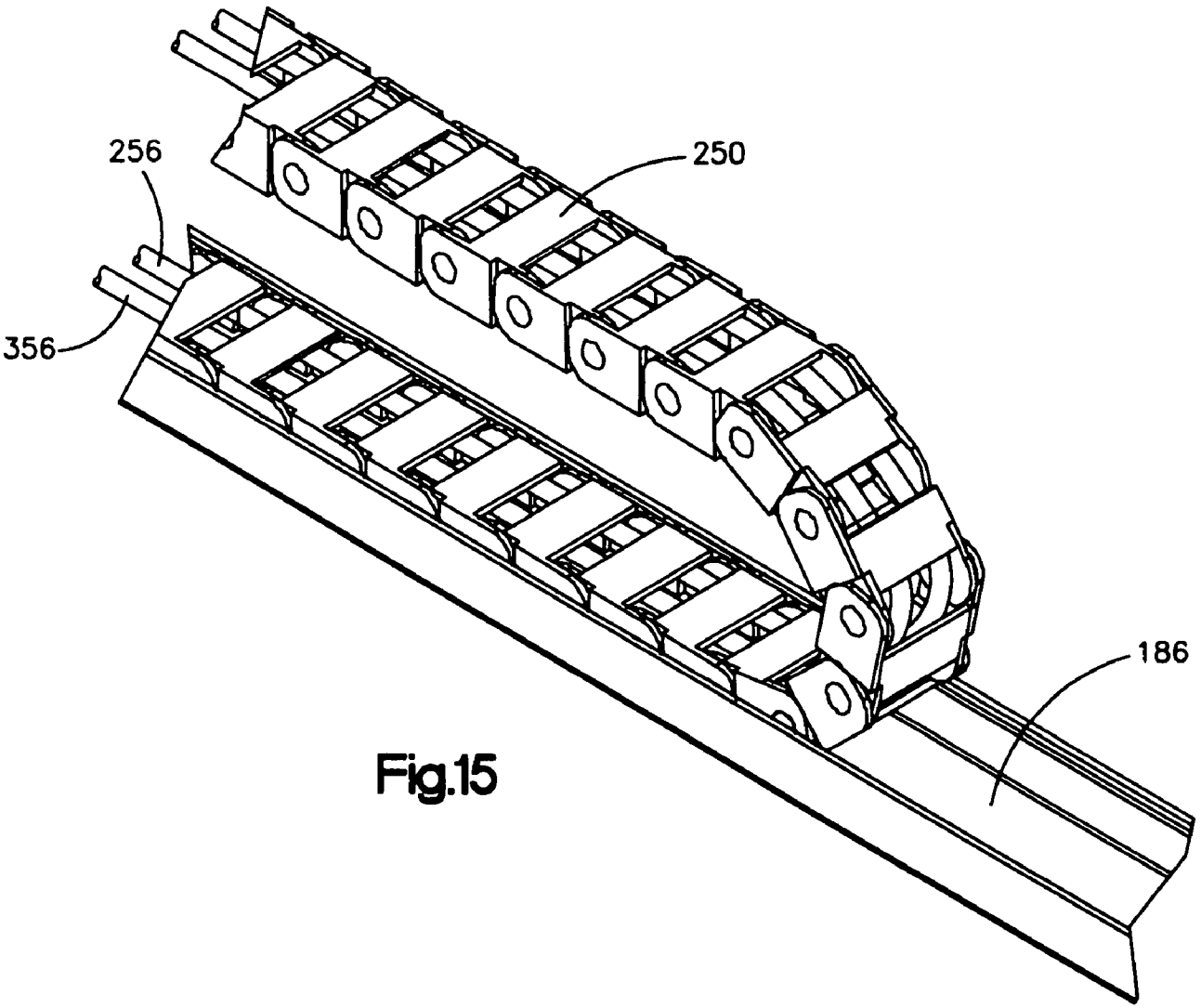
FIG. 15 is a perspective view of a further aspect of the invention.

As best seen in FIG. 15 is a partial assembly of the insertion tool cable carrier 180. A cable carrier 250 is obtained to fit within the insertion tool cable carrier channel 186 of the insertion tool cable carrier 180. The cable carrier 250 permits the later described wellhead communication equipment to be transported from a T-head into the wellhead. The sidewalls of the insertion tool cable carrier 180 at least partially define the area within which the cable carrier 250 may traverse.

Figure 17:
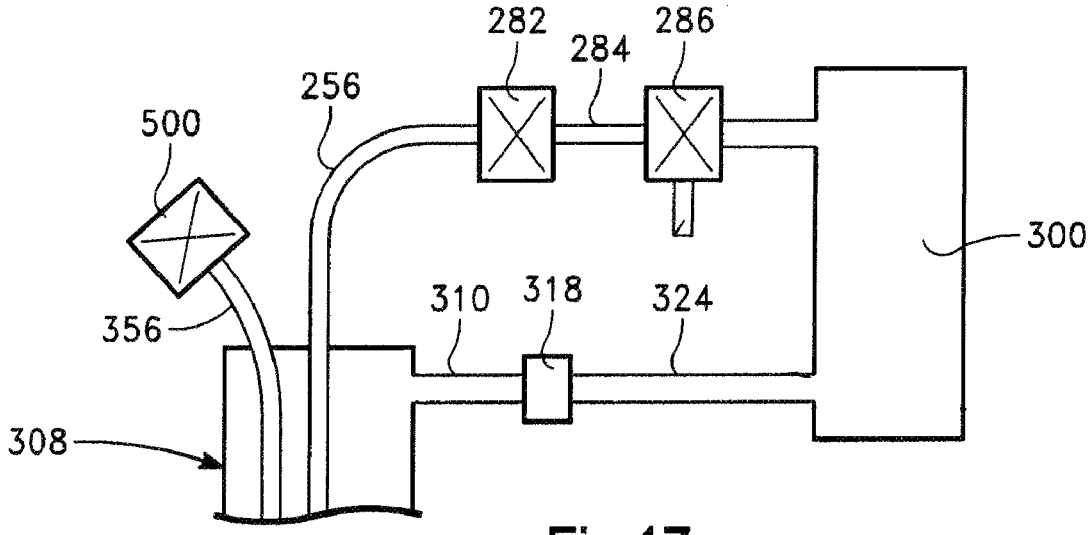
FIG. 17 is a further partial view of a wellhead with various aspects of the present invention.
Figure 18:
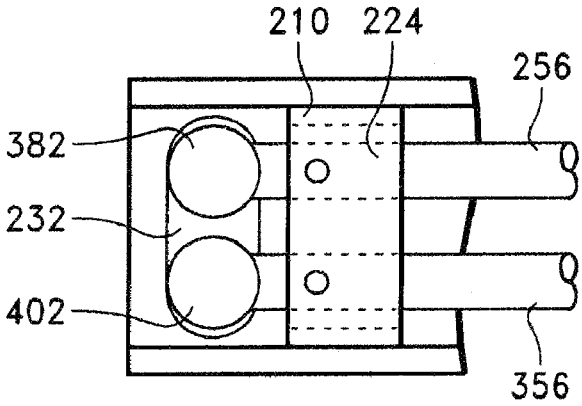
FIG. 18 is a bottom view of an aspect of the invention according to FIG. 16; and, FIG. 19 is a top view of an aspect of the invention according to FIG. 16.
Figure 19:
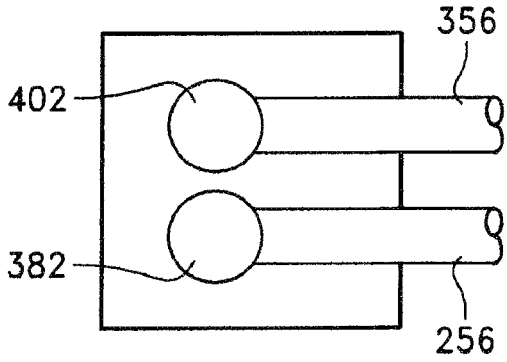
Figure 20:
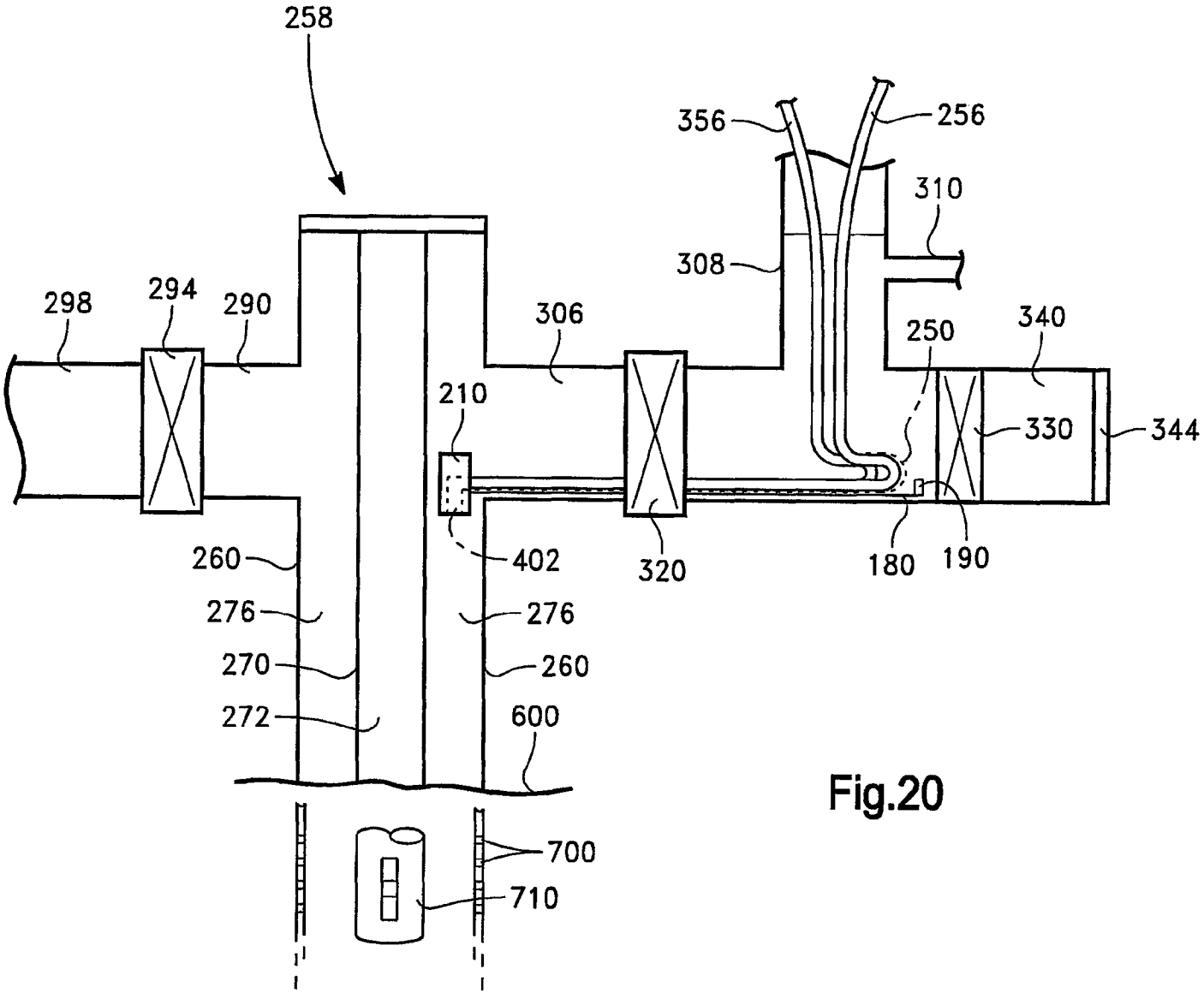
FIG. 20 is a partial view of a wellhead with various aspects of the present invention, including a downhole pump.

Gas emission tubing 256 is shown in FIG. 17. The gas emission tubing 256 effectively terminates in the well annulus as later described. The gas emission tubing 256 is located within the cable carrier 250. The gas emission tubing 256 is connected to compressor valve 282. The compressor valve 282 serves to permit gas flow from compressor 300 through conduit 284.

The conduit 284 is in fluid communication with pressure transducer 286. The pressure transducer 286 controls the pressure of a sample of gas to be returned to the well annulus through gas emission tubing 256. The pressure transducer 286 is in fluid communication with a compressor 300.

Figure 16:
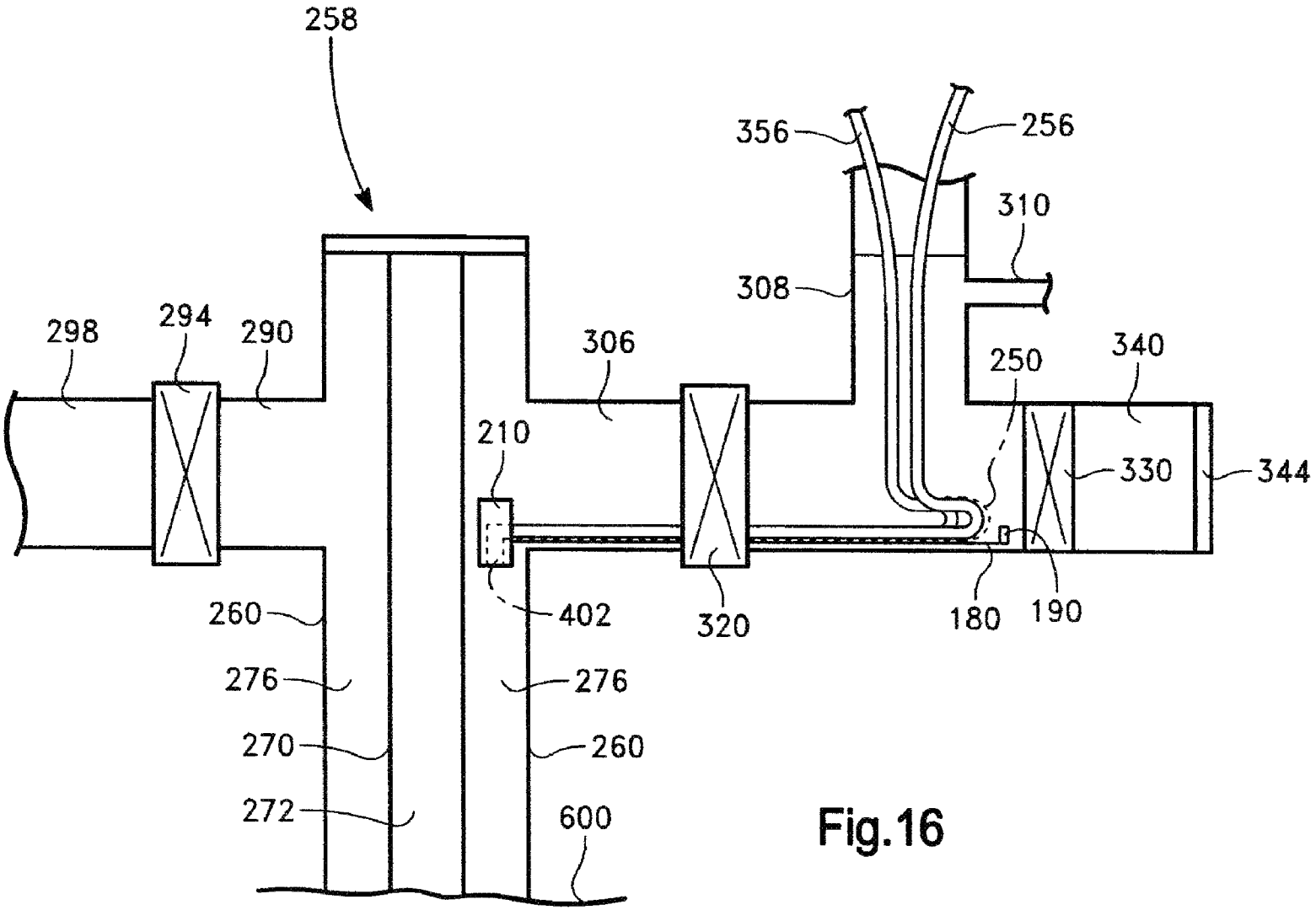
FIG. 16 is a partial view of a wellhead with various aspects of the present invention.

As seen in FIG. 16 is a partial assembly of the present invention. A wellhead 258 is the focus of the present invention. The wellhead 258 is comprised of a well casing 260 and an inner well casing 270. An inner well casing void 272 is effectively defined by the inner well casing 270.

A well annulus 276 is defined as the space between the well casing 260 and inner well casing 270. The wellhead 258 is capped to prevent communication of fluids from the inner well casing void 272 and well annulus 276 from reaching the atmosphere. In this definition, fluid includes liquids and gases.

A wellhead first t-conduit 290 extends from one side of the wellhead 258. A wellhead first valve 294 regulates the flow of fluids from the wellhead 258. The wellhead first valve 294 is connected with a wellhead conduit 298. The wellhead conduit 298 transports fluids to a desired region such as a tank or pipeline.

On the opposite side of the wellhead 258 from the wellhead first t-conduit 290 is a wellhead second t-conduit 306. It is the noted that the wellhead first t-conduit 290 and the wellhead second t-conduit 306 are interchangeable. While the wellhead first t-conduit 290 and a wellhead second t-conduit 306 are described as being on opposite sides and coaxially located to one another on the wellhead 258 such need not be the case.

A wellhead second t-conduit takeoff pipe 308 extends from and is in fluid communication with the wellhead second t-conduit 306. A wellhead takeoff pipe 310 extends from the wellhead second t-conduit takeoff pipe 308. A filter apparatus 318 is in fluid communication with the wellhead takeoff pipe 308.

The filter apparatus 318 is in fluid communication with a conduit 324. The filter apparatus 318 serves to remove debris produced through the wellhead which would otherwise pass from the wellhead second t-conduit takeoff pipe 308 through conduit 324 to the compressor 300.

The compressor 300 is the connected with the conduit 324. The compressor 300 when in use compresses gas from the well annulus 276. A wellhead second valve 320 regulates communication of fluids to the wellhead second t-conduit takeoff pipe 308. The wellhead second valve 320 also serves to permit insertion of the other components of the invention such as the insertion tool shaft 60 through the wellhead second valve 320.

A wellhead third valve 330 is located at the opposing side of the wellhead second t-conduit takeoff pipe 308 from the wellhead second valve 320. A wellhead second conduit 340 is connected to the wellhead third valve 330. The wellhead second conduit 340 terminates with a wellhead second conduit threaded region 344. The wellhead second conduit inner threaded region 344 is normally capped off with a standard well cap (not shown).

As seen in FIG. 16, the cable carrier 250 passes through the open wellhead second valve 320 to permit access of the insertion tool cable carrier tray receiver locking mechanism 210 to the well annulus 276.

The gas emission tubing 256 passes through insertion tool cable carrier receiver locking mechanism first channel 224 and into the insertion tool cable carrier down hole opening 232. When in use compressed gas from the gas emission tubing 256 exits from a gas injection port 382 and into the well annulus 276.

A gas receiving tubing 356 extends through one of the openings in the insertion tool cable carrier receiver locking mechanism 210 and communicates with a gas injection port 382 in the insertion tool cable carrier down hole opening 232. The gas receiving tubing 356 is in fluid communication with a pressure measurement device 500. Conveniently, the pressure measurement device 500 is an accelerometer.

The gas injection port 382 and the sample receiving port 402 are positioned in the wellhead such that they may be aligned to the well annulus 276. An the advantage to having the gas injection port 382 and the sample receiving port 402 aimed directly downhole is to minimize any noise or problems caused by moving the injected gas at right angles as would occur if the injected gas exits the gas injection port 382 in the wellhead takeoff pipe 310.

In operation, a pump 710 is employed to control the fluid level 600 in the well annulus 276. The inner well casing void 272 and the well annulus 276 are in fluid communication below the fluid level 600.

To maximize fluid flow through perforations 700 into the wellbore, the fluid level 600 should be maintained as low as possible with respect to the perforations to reduce the hydrostatic head in the well casing 260. The pump is set to operate at a desirable fluid level and the desirable fluid level is controlled by implementing changes in the pumping based upon readings from the pressure measurement device 500.

To correctly position the equipment of the present invention the insertion tool 10 is assembled as shown in FIG. 1. A cap (not shown) is removed from the wellhead second conduit threaded region 344. The insertion tool 10 is then screwed on to the wellhead second conduit 340 by the insertion tool bell external threading 24. The insertion tool shaft 60 may then be inserted through the wellhead third valve 330.

As shown in FIG. 16 and FIG. 17, the cable carrier 250 carries and protects the emission tubing 256 and gas receiving tubing 356 through the wellhead second t-conduit takeoff pipe 308. The cable carrier 250 is positioned in the insertion tool cable carrier channel 186. The cable carrier 250 is fastened at the insertion tool cable carrier tray receiver locking mechanism 210.

The insertion tool shaft 60 as previously noted is inserted through the wellhead third valve 330 and is connected with the insertion tool cable carrier 180 at the insertion tool cable carrier receiving piece 190. That is the insertion tool shaft 60 is inserted through the insertion tool cable carrier receiving piece first channel 194 and makes contact with the back wall of the insertion tool cable carrier receiving piece 190.

The insertion tool shaft 60 is then rotated 90 degrees in the insertion tool cable carrier receiving piece second channel 198 as the length of the insertion tool shaft 60 is known and the length of the wellhead second conduit 340 is known as well as the width of the wellhead third valve 330 one may determine with a fair degree of accuracy that the insertion tool shaft 60 has correctly engaged the insertion tool cable carrier 180.

Once the insertion tool shaft 60 has been inserted through wellhead third valve 330 and locked to the insertion tool cable carrier 180 previously disposed within wellhead second t-conduit takeoff pipe 308, the insertion tool cable carrier 180 is then used to urge the insertion tool cable carrier 180 forward through the open wellhead second valve 320 and through the wellhead second t-conduit 306 to correctly position the insertion tool cable carrier tray receiver locking mechanism 210 above the annulus.

The insertion tool shaft 60 may then be disengaged by rotating the insertion tool shaft projection 82 from the insertion tool cable carrier receiving piece second channel 198 and withdrawing the insertion tool shaft 60 from the insertion tool cable carrier receiving piece first channel 194. The insertion tool shaft 60 may then be further withdrawn through the insertion tool bell 20 to a point sufficient in the wellhead second conduit 340 to permit the closing of the wellhead third valve 330.

The insertion tool bell 20 may then be unscrewed from the wellhead second conduit inner threaded region 344. The insertion tool 10 may be utilized for several wells rather than having a single insertion tool 10 permanently connected to each well. For the servicing of the components the entire operation may be reversed. That is, the insertion tool 10 is connected to the wellhead second conduit 340 and the wellhead third valve 330 valve is opened.

The insertion tool shaft 60 is then engaged to the insertion tool cable carrier receiving piece 190. The insertion tool cable carrier 180 is then drawn in the direction of the wellhead second conduit 340 and the insertion tool cable carrier 180 and the insertion tool cable carrier tray receiver locking mechanism 210 are removed through the wellhead second valve 320. The wellhead second valve 320 is then closed. The insertion tool cable carrier tray receiver locking mechanism 210 may then be completely withdrawn through the wellhead third valve 330.

At this point the wellhead third valve 330 may also be closed although it is noted that as the wellhead second valve 320 is in the closed position the well is not in fluid communication with the atmosphere. The gas injection port 382 and the sample receiving port 402 may then be serviced outside of the well.

Alternatively the insertion tool cable carrier 180 may be withdrawn through the wellhead second t-conduit takeoff pipe 308 for service. As the well is normally furnished with the wellhead first valve 294 and the wellhead second valve 320 in place the entire segment of the wellhead second t-conduit takeoff pipe 308 may be added by the supplier of the communication equipment.

From the above description of the invention, those skilled in the art will perceive improvements, changes and modifications. Such improvements, changes and modifications within the skill of the art are intended to be covered by the appended claims.

What is claimed is:

1. A device for controlling fluid levels in a well comprising:

a compressor;

a conduit to provide fluid communication between a well annulus and said compressor;

a pressure transducer in fluid communication with said compressor, said pressure transducer, when used in combination with a valve and the compressor, releases a charge of compressed gas into the well annulus through a gas emission tubing;

a gas receiving tube to provide fluid communication between the well annulus and a pressure measurement device wherein the gas emission tubing and the gas receiving tube are substantially disposed within a carrier tray;

said pressure measurement device having means for ascertaining a return signal from the charge of compressed gas, wherein said return signal enables a determination of the well fluid level.

2. The device for controlling fluid levels in a well according to claim 1, wherein a gas injection port is the terminus of said gas emission tubing and provided further said gas injection port is facing in a substantially downhole direction over the well annulus.

3. The device for controlling fluid levels in a well according to claim 1, wherein a sample receiving port is the terminus of said gas receiving tubing and provided further said sample receiving port is facing in a substantially downhole direction over the well annulus.

4. The device for controlling fluid levels in a well according to claim 1, wherein said pressure measurement device is an accelerometer.

5. The device for controlling fluid levels in a well according to claim 1 further comprising a pump which is activated or deactivated according to the determined fluid level.

6. The device for controlling fluid levels in a well according to claim 1 wherein the charge of compressed gas comprises a produced gas from the well.

7. The device for controlling fluid levels in a well according to claim 1 where the carrier tray is substantially contained within the conduit, the carrier tray having a first end and a second end.

8. The device for controlling fluid levels in a well according to claim 7 wherein the gas emission tubing and the gas receiving tube each comprise a terminus disposed at the second end.

9. The device for controlling fluid levels in a well according to claim 8 wherein the carrier tray may be disposed within a plurality of positions within the conduit, ranging from an extended position wherein the second end is disposed immediately adjacent to the annulus to a retracted position wherein the second end is wholly inside the conduit.

10. The device for controlling fluid levels in a well according to claim 9 wherein an insertion tool shaft may be attached to the carrier tray and utilized to either move the carrier tray from the retracted position to the extended position or from the extended position to the retracted position.

* * * * *